US006416217B1

(12) United States Patent
Von Braunhut

(10) Patent No.: US 6,416,217 B1
(45) Date of Patent: Jul. 9, 2002

(54) AQUARIUM WATCH

(76) Inventor: Harold Von Braunhut, P.O. Box 809, Bryans Rd., MD (US) 20616-0809

( * ) Notice: Subject to any disclaimer, the term of this patent is extended or adjusted under 35 U.S.C. 154(b) by 0 days.

(21) Appl. No.: 09/761,366

(22) Filed: Jan. 16, 2001

(51) Int. Cl.[7] ..... G04B 37/00; G04B 37/12

(52) U.S. Cl. ..... 368/278; 368/10; 368/62; 368/67; 368/223; 368/226; 368/285

(58) Field of Search ..... 368/10, 62, 65, 368/67, 76, 77, 80, 116, 223–227, 240, 278, 285

(56) References Cited

U.S. PATENT DOCUMENTS

| | | | |
|---|---|---|---|
| 410,808 | A | 9/1889 | Schelker |
| 947,937 | A | 2/1910 | Porter |
| 1,006,965 | A | 10/1911 | Matalene |
| 2,746,237 | A | 5/1956 | Anderson |
| 4,945,523 | A | 7/1990 | Lam |
| 5,272,681 | A | 12/1993 | Lee |
| 5,305,292 | A | 4/1994 | Reynoso |
| 5,652,736 | A | 7/1997 | Lee |
| 5,751,667 | A | 5/1998 | Nunes |
| 5,850,373 | A | 12/1998 | Lee |
| 5,923,623 | A | 7/1999 | Lee |

*Primary Examiner*—David Martin
*Assistant Examiner*—Michael L. Lindinger
(74) *Attorney, Agent, or Firm*—Katten Muchin Zavis Rosenman

(57) ABSTRACT

A timepiece has a removably attachable aquarium adapted to support aquatic life. Living aquatic pets are introduced into the aquarium prior to attaching the aquarium to the timepiece. A wearer of such timepiece is then able to contemporaneously tell time and enjoy watching the living aquatic pets. A kit is also provided with a timepiece, an aquarium and aquatic life adapted to be supported in said aquarium.

37 Claims, 12 Drawing Sheets

AQUARIUM WATCH

FIELD OF THE INVENTION

This invention relates to watches and aquariums in general, and more specifically to a combination watch and aquarium for housing and displaying living creatures.

BACKGROUND OF THE INVENTION

Kids love pets. For some children, pets serve as friends, confidants, items of affection and items of consolation. For other children, pets take the place of brothers or sisters they never had or will have.

One of the easiest types of pets to take care of are fish. Fish will generally live for a long time as long as they are fed regularly and provided with a clean and healthy environment. One example of an aquatic pet that has been providing children with years of enjoyment is the inventor's own Sea Monkeys®.

Aquatic pets, however, tend to have one major drawback to providing round the clock enjoyment. They must be kept in a large tank sufficient to support their life. Such tank is usually stationary, kept in one particular location. Thus, children, and also some adults for that matter, are usually left to dreaming about fish playtime when sitting at school or congregating at a friend's house. Often times, children are left to fixate on their watch, counting down the hours, minutes and finally seconds until they can get back to playtime with the fishes.

There is a need, therefore, for a means to allow fish lovers and the like to enjoy their aquatic friends "round the clock," so to speak. Such need is met by the watch of the present invention, which is adapted to contain and display live aquatic pets while worn on the wrist of the user, while at the same time providing the user with the time of day. Such need is more particularly met by the watch system of the invention, which is provided with a watch and aquatic pet life adapted to be displayed in such watch.

The watch system of the present invention differs significantly from the prior art, which is limited to supporting and displaying ornamental life, not actual life. For example, U.S. Pat. No. 5,652,736 to Lee discloses a sealed, fluid-filled container detachably attached to a wristwatch for housing ornamental objects. Similarly, in U.S. Pat. No. 5,305,292 to Reynoso, the watch dials are immersed in a fluid adapted to contain ornamental floating articles such as fake divers and fake fish. Neither the Lee nor Reynoso aquatic environments are suitable for the introduction and continued support of aquatic pet life. Ornamental aquatic life in a timepiece is also displayed in U.S. Pat. Nos. 5,272,681 and 5,850,373 both to Lee.

OBJECTS OF THE INVENTION

It is an object of the present invention, therefore, to provide a watch that is constructed and adapted to support aquatic pet life.

It is a further object of the present invention to provide a watch having an aquarium that is adapted to support aquatic pet life.

It is a still further object of the present invention to provide a watch having an aquarium whereby a user can view the time displayed on the watch through the living environment of the aquarium.

It is a still further object of the present invention to provide a watch having a detachable aquarium that is adapted for the introduction and removal of aquatic life therefrom.

It is a still further object of the present invention to provide a watch system having a time piece, a detachable aquarium and aquatic pet life adapted to be housed within said aquarium.

It is a still further object of the present invention to provide a life-supporting aquarium adapted for engagement with a wristwatch.

Still other objects and advantages of the invention will become clear upon review of the following detailed description in conjunction with the appended drawings.

SUMMARY OF THE INVENTION

A timepiece is provided with a removably attachable aquarium adapted to support aquatic life. The aquarium is provided with a plug that seals the aquarium and permits the introduction of aquatic life into the aquarium. Once aquatic life is introduced into the aquarium, the aquarium is attached to the timepiece and a wearer of such timepiece is then able to contemporaneously tell time and enjoy watching the aquatic life. A kit is also provided with a timepiece, an aquarium and aquatic life adapted to be supported in said aquarium.

DETAILED DESCRIPTION OF THE PREFERRED EMBODIMENTS

Figure 1:
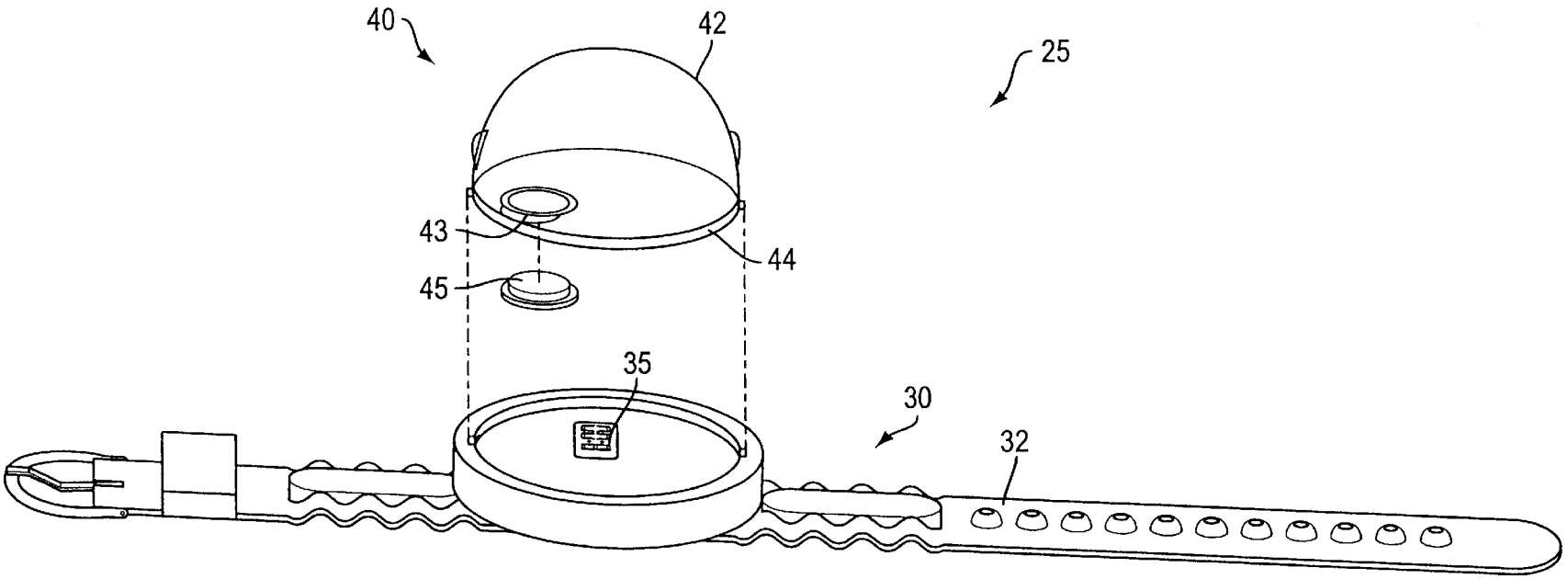
FIG. 1 is an exploded view of the aquarium watch of the present invention.

The present inventor is also the owner of U.S. Pat. No. 3,673,986 and the creator of the Sea Monkey® phenomenon. For purposes of illustration and explanation, the inventor's own Sea Monkeys® will be used as an example of aquatic life or aquatic pets capable of being contained and displayed within the aquarium watch of the present invention. Clearly other aquatic life forms may be usable with the present invention. However, the use of Sea Monkeys® is preferable to other aquatic life because of their size, their constant movement and their history of providing children around the world with hours of entertainment.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIG. 1 is an exploded view of the aquarium watch 25 of the present invention, which comprises a timepiece 30 having a wrist strap 32 and a display 35, and an aquarium 40 attachable to said timepiece 30. For purposes of explanation, the timepiece 30 will be described as a wrist watch preferably having a digital display 35, although other portable timepieces such as stop watches, or analog time pieces such as pocket watches will be sufficiently operable. The aquarium 40 of the invention is generally hemispherical and is provided with an inner chamber 43 sealed between a dome-shaped upper surface 42 and a relatively flat lower surface 44. A plug member 45 is removably attachable to said lower surface 44 for permitting the introduction of aquatic life into said chamber 43 of said aquarium 40 and for sealing aquatic life within said chamber 43. Also, the aquarium 40 is preferably attached to the timepiece 30 so that the lower surface 44 is adjacent the time display 35 for contemporaneous viewing of the time and the inhabitants of the aquarium. However, it will be understood that the aquarium 40 could also attach to the side of the watch opposite. the display side (not shown), in which case the user could view the time on one side of the watch, and the inhabitants of the aquarium on the other side of the watch. Such an embodiment might be useful for individuals that wear watches with the display side adjacent their inner wrist.

Figure 12:
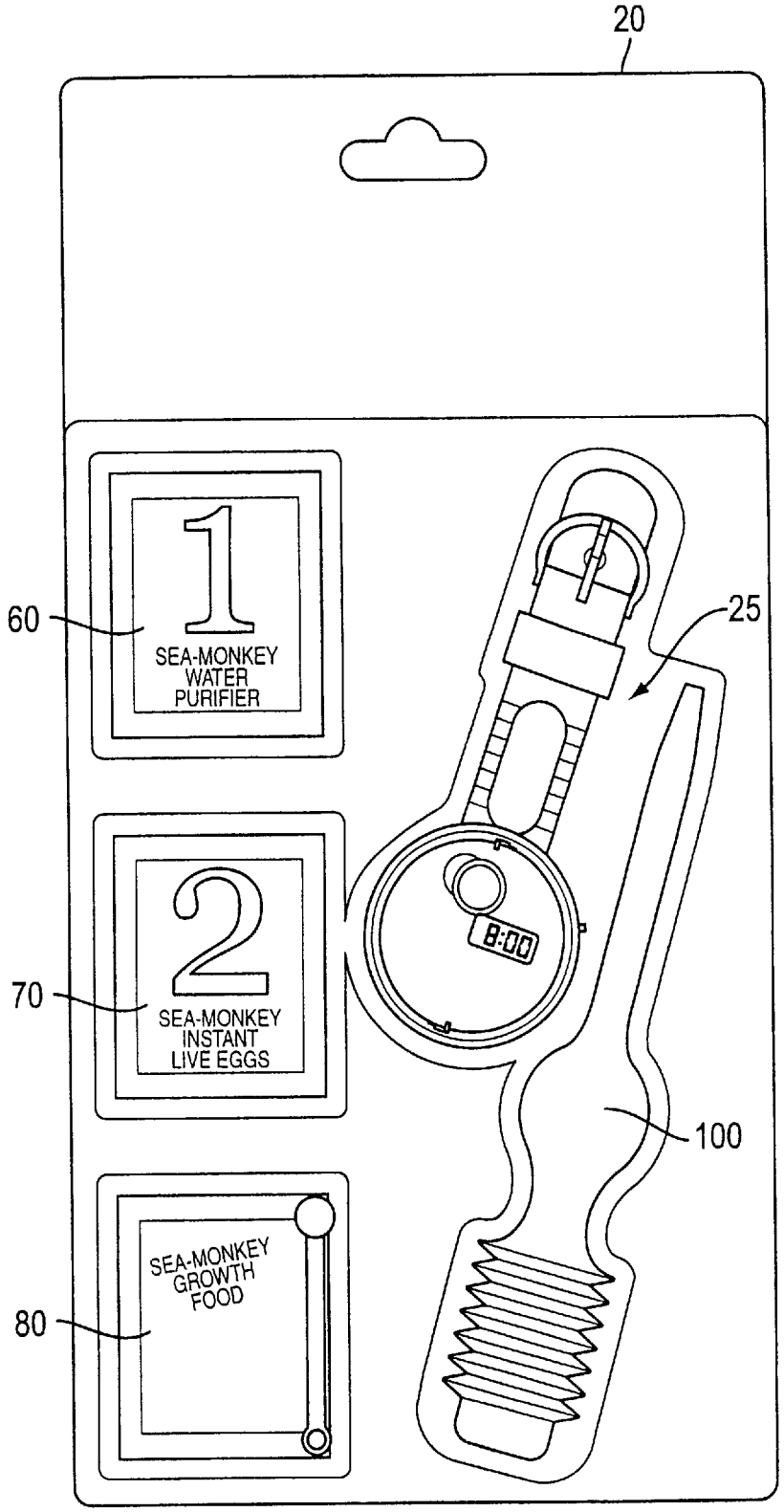
FIG. 12 is a kit containing the aquarium watch of the present invention.

As noted above, the inventor's own Sea Monkeys® will be used to demonstrate the use and enjoyment of the aquarium watch 25 of the present invention. In this regard, FIG. 12 illustrates a kit 20 containing an aquarium watch 25 as well as means to grow, nourish and manipulate aquatic life which will be displayed in such watch 25. Use of the components of the kit 20 of FIG. 12 will now be explained.

Figure 2:
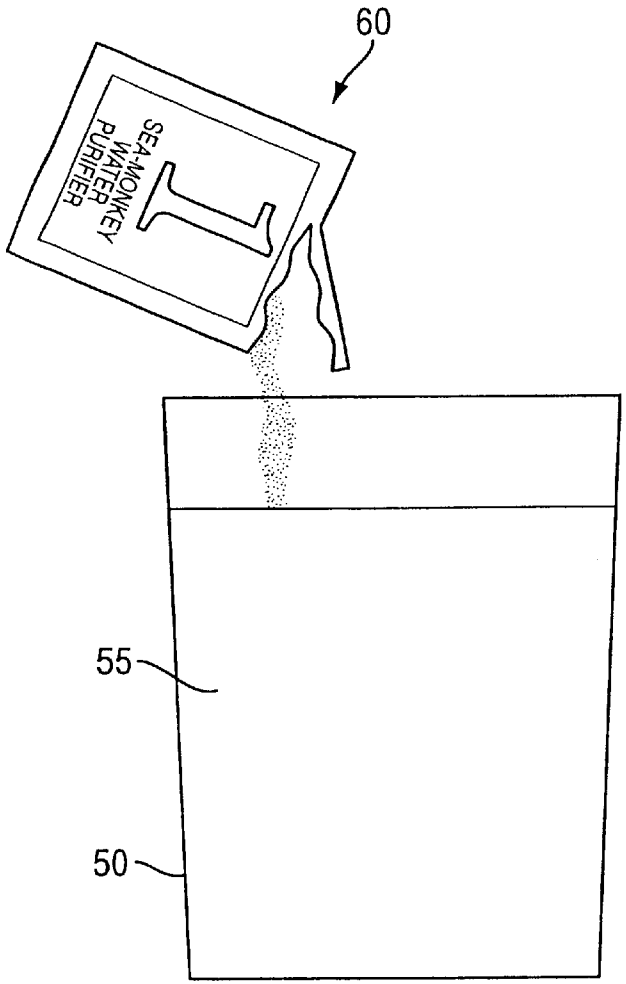
FIG. 2 illustrates the application of a water purifier to an aqueous environment in preparation for the introduction of aquatic life.

As shown in FIG. 2, a separate living environment, such as a drinking glass 50 or the like 50, is filled with an aqueous solution such as tap water 55. A water purifier and conditioner package 60 (contained within the kit 20) is added to the water 55 to prepare the water 55 for introduction of aquatic life. The purifier 60 preferably contains materials, which when dissolved in the tap water 55 create the necessary environment in which the aquatic life, and in this case Sea Monkeys® or hybrid brine shrimp, will hatch and develop. The purifier 60 also contains a material to remove any harmful chemicals, such as chlorine contained in the ordinary tap water, chlorine being harmful to aquatic life, and in the case of Sea Monkeys® hybrid brine shrimp. The purifier package 60 may also contain some dried eggs of small aquatic life, such as, but not limited to, hybrid brine shrimp. In order to maintain the contents of the purifier package 60 in a dry moisture-free condition and thus inhibit premature hatching of the brine shrimp, a drying agent may be included therein. This dry mixture may be kept preferably in a moisture-proof package for an indefinite period of time with little or no loss of its properties.

Figure 3:
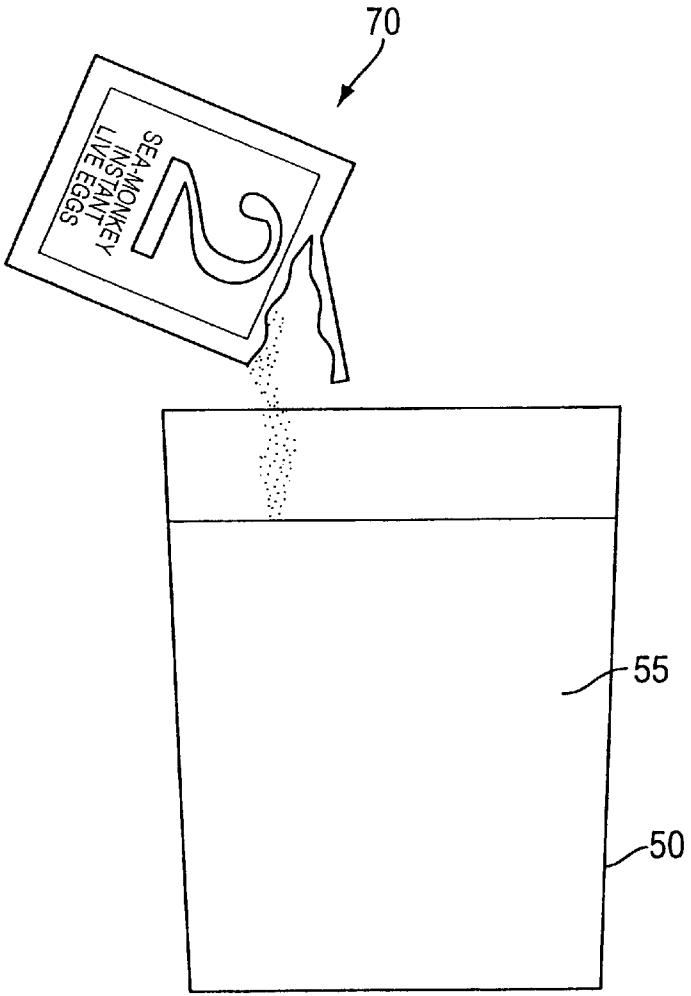
FIG. 3 illustrates the introduction of aquatic life to the purified aqueous environment of FIG. 2.

After the tap water 55 has been purified, conditioned and aged as hereinbefore described, a second package 70 (contained within the kit 20 of FIG. 12) is added to the treated water 55 as shown in FIG. 3. The second package 70 contains additional salts for the maintenance of the required saline environment, food material such as yeast for the hatched and developing aquatic life, or in this case Sea Monkeys® or hybrid brine shrimp, as well as additional dried eggs of small marine life or hybrid brine shrimp. The brine shrimp will be viewable in the water 55 upon the introduction of the contents of the second package 70 to the environment 50, although such shrimp will appear very small and thus difficult to ascertain for at least a couple of days. The contents of the second package 70 are also preferably sealed in a moisture-proof container so that it may be kept dry for an indefinite period of time with little or no loss of its properties.

Figure 5A:
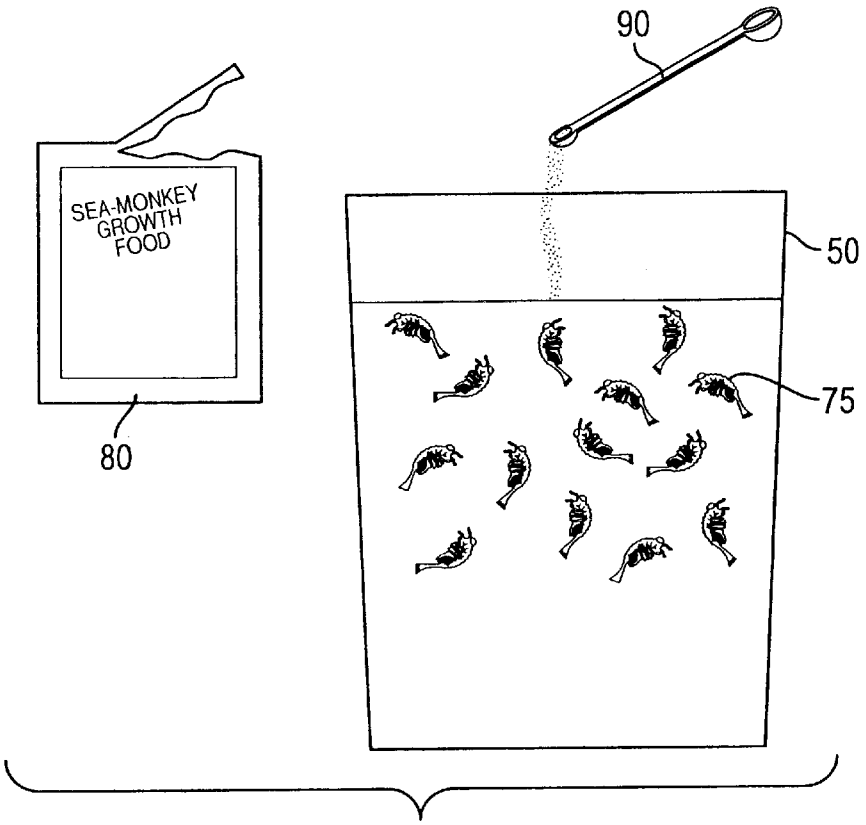
FIG. 5A illustrates the introduction of growth food to the aquatic life in an aqueous environment.
Figure 4:
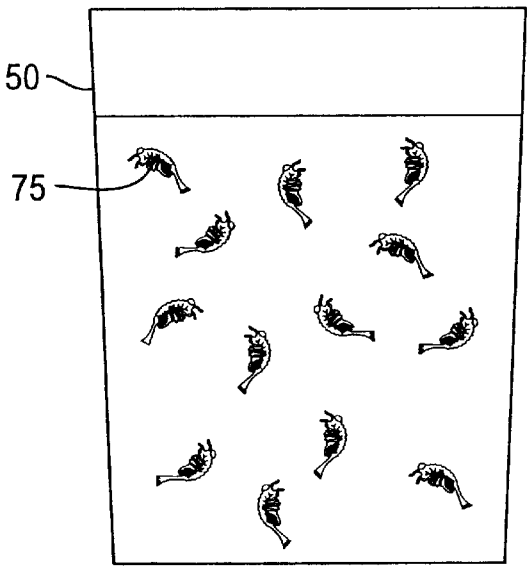
FIG. 4 illustrates aquatic life in an aqueous environment.
Figure 5B:
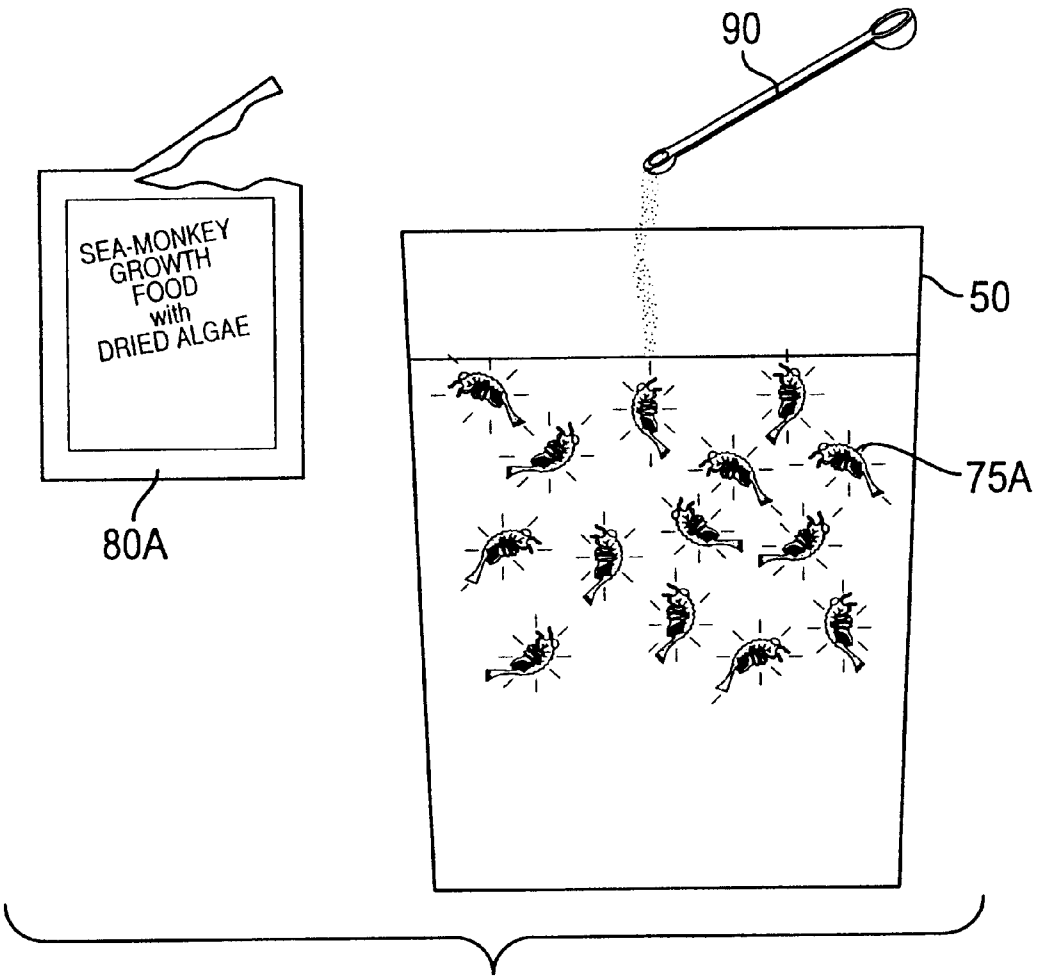
FIG. 5B illustrates the introduction of an alternative growth food to the aquatic life in an aqueous environment.

FIG. 4 illustrates aquatic life 75, and in this case Sea Monkeys® or hybrid brine shrimp, happily swimming and frolicking in its aqueous environment 50. In order to maintain and nourish the aquatic life 75 in its environment 50, the user may introduce a small amount of food from the food package 80 (contained within the kit 20) into the water 55 of the environment 50 as shown in FIG. 5A, preferably with the feeding spoon 90 contained within the kit 20 of FIG. 12. Alternatively, as shown in FIG. 5B, the user may introduce a food package 80A containing dried algae, which results in the appearance of colored aquatic life 75A upon the consumption of such food 80A. In this case, it is preferable, for example, if the aquatic life 75A appears red, which may highlight the presence of such aquatic life 75A against a dark background. The use of other additives that result in other colored appearances are also contemplated.

After the aquatic life 75 has been nourished and fed, they may be introduced into the aquarium 40 and viewed and enjoyed separately while in the aquarium 40. It is preferable if the aquarium 40 containing aquatic life 75 is attached to the timepiece 30 of the present invention, so that a user may also enjoy the aquatic life 75 while being able to tell time at the same time.

The introduction of aquatic life into the aquarium watch of the present invention will now be described in connection with FIGS. 6–11. It will be understood that the preceding discussion is specific to the cultivation of Sea Monkeys® or hybrid brine shrimp as used in connection with the kit of FIG. 12. However, it will also be understood that the aquarium watch of the present invention may be used with aquatic life other than Sea Monkeys® or hybrid brine shrimp. Thus, the introduction of aquatic life into the aquarium watch of the present invention as described in connection with FIGS. 6–11 will not necessarily be dependent on the use of the kit of FIG. 12 to cultivate and grow such aquatic life.

Figure 6:
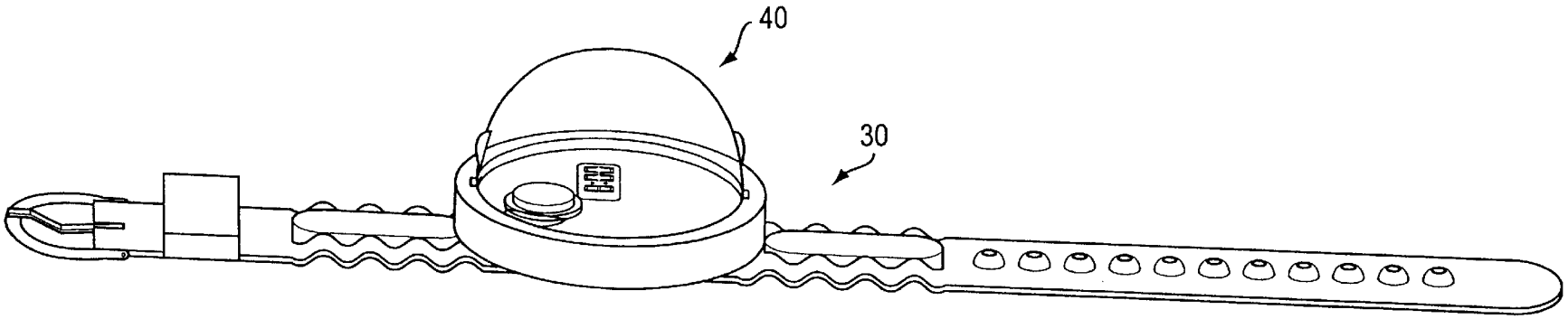
FIG. 6 is an assembled view of the aquarium watch of the present invention.
Figure 7:
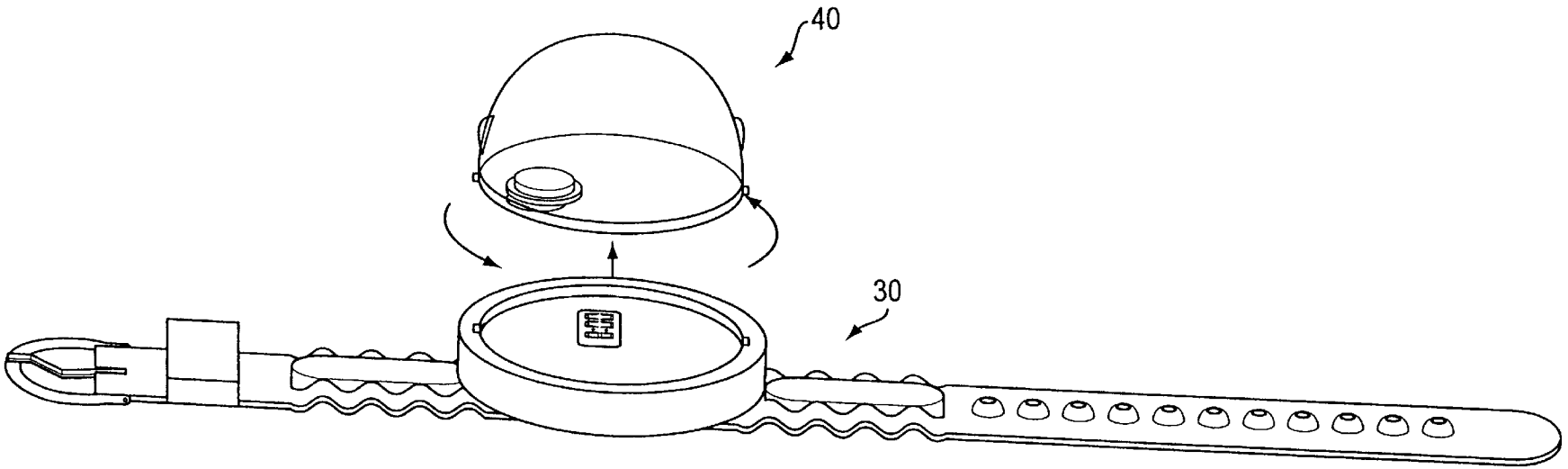
FIG. 7 illustrates the removal of the aquarium from the watch of FIG. 6.

Prior to introducing aquatic life 75 into the aquarium 40, the aquarium must be separated and freed from the timepiece 30 as shown in FIGS. 6 and 7. If the aquarium timepiece of the present invention is sold in an assembled condition as shown in FIG. 6, then the aquarium 40 must be separated from the timepiece 30 as shown in FIG. 7. The aquarium 40 is preferably attached to the timepiece 30 by means of a bayonet-type lock, which is a fairly secure type of removable, rotatable interlock. Of course, other connection methods may be used for attaching the aquarium 40 to the timepiece 30.

Figure 8:
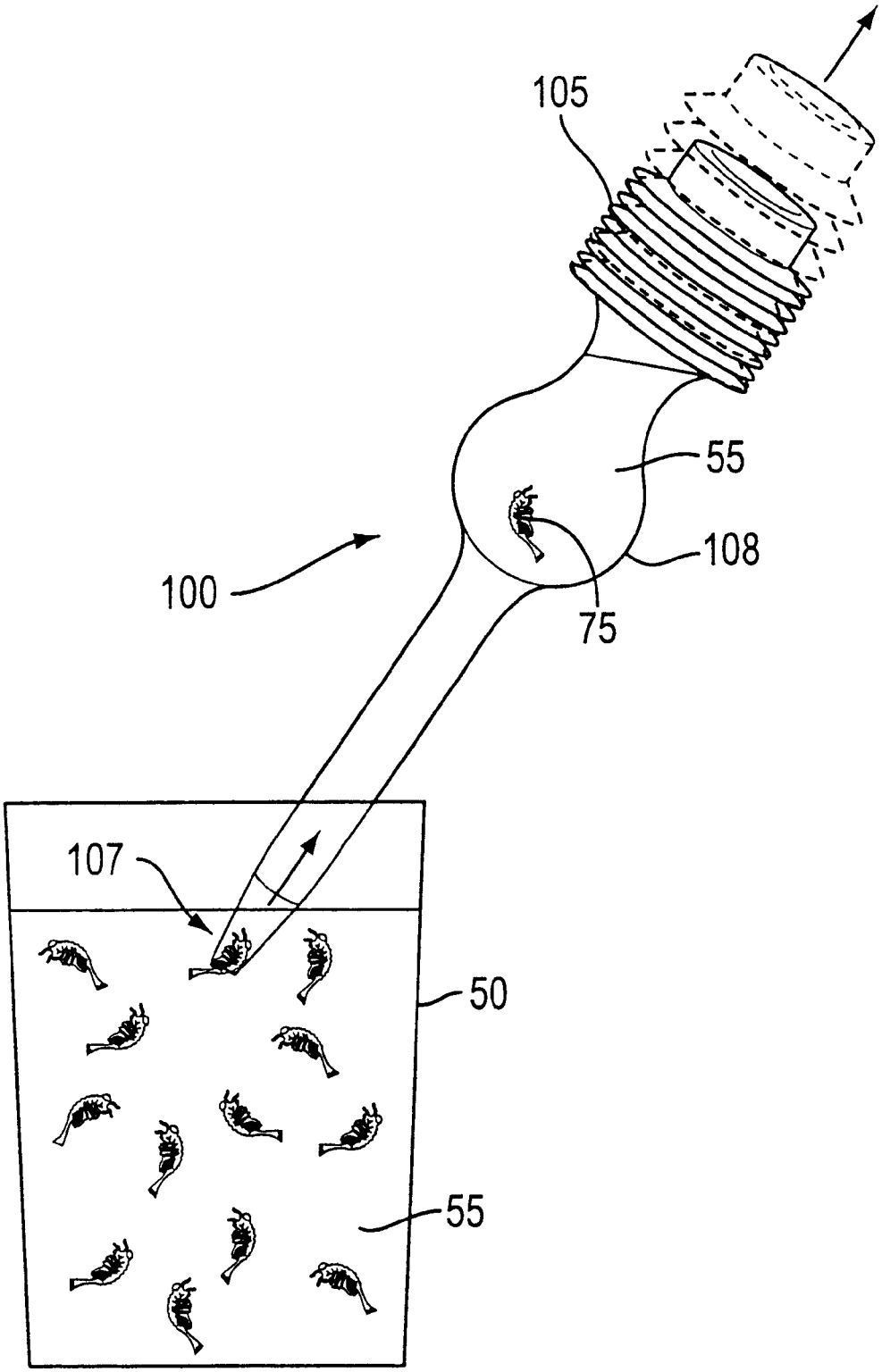
FIG. 8 illustrates the use of a transport member to withdraw aquatic life from a separate, aqueous environment.
Figure 9:
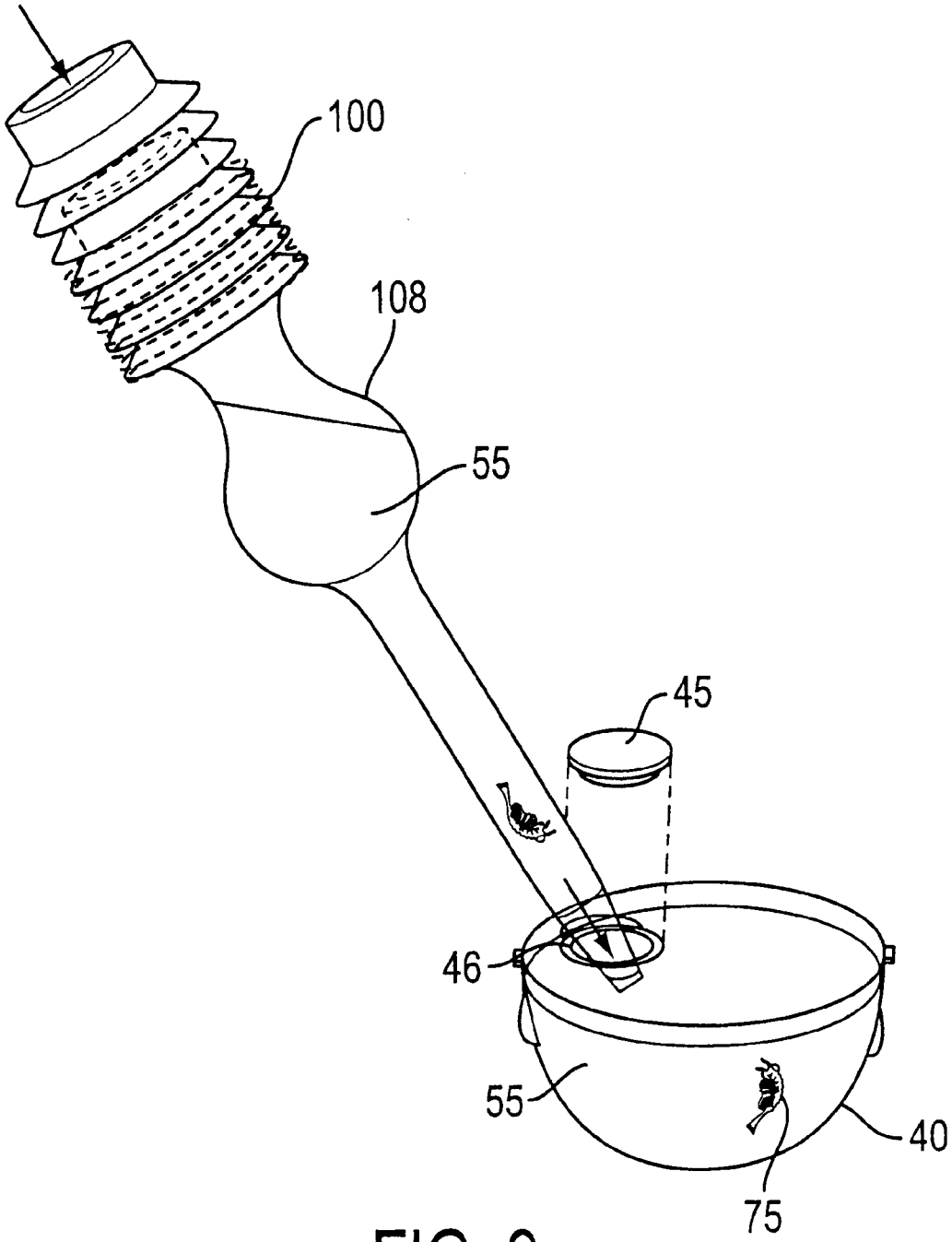
FIG. 9 illustrates the use of a transport member to introduce aquatic life into an aquarium.

FIG. 8 illustrates the use of a transport member 100 to withdraw aquatic life 75 from its separate, aqueous environment 50, while FIG. 9 illustrates the use of said transport member 100 to introduce aquatic life 75 into the aquarium 40 of the invention. The transport member 100 has a bellows-type handle 105 which, when expanded as shown in FIG. 8, causes the aquatic life 75 and its aqueous environment 55 to be sucked through an opening 107 at the end of the transport member 100 opposite the handle 105 and into a transport chamber 108 between the handle 105 and opening 107. As shown in FIG. 8, the transport member 100 is then inserted into the aquarium 40 through the plug opening 46 and the handle 105 is compressed, forcing the contents of the transport chamber 108 into the aquarium 40. While the transport member 100 of the invention happens to be sold with the kit 20 of FIG. 12, other types of transport members may be used as desired to convey aquatic life 75 to the aquarium 40 of the invention.

Figure 10:
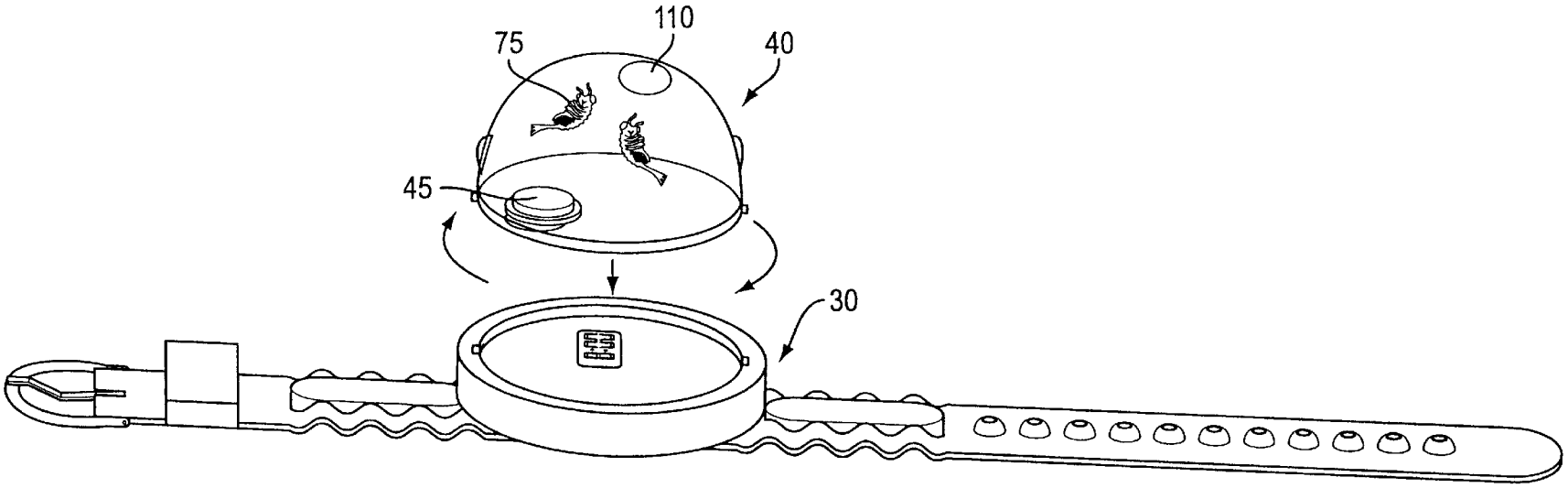
FIG. 10 illustrates the attachment of an aquarium containing aquatic life to a timepiece.
Figure 11:
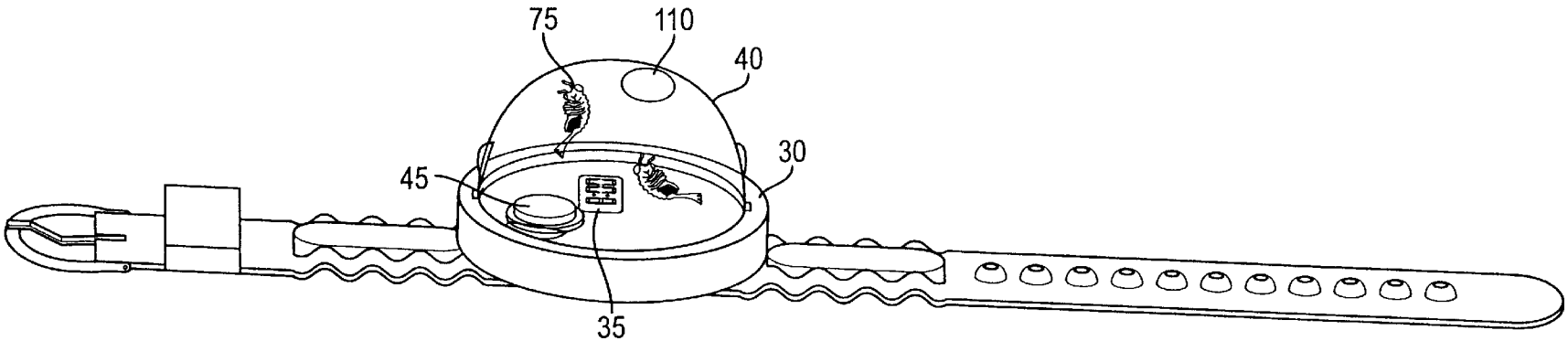
FIG. 11 illustrates an aquarium containing aquatic life attached to a timepiece.

Once the aquarium 40 is filled with aquatic life 75, the aquarium 40 is sealed with the plug member 45 and attached to the timepiece 30 as shown in FIGS. 10 and 11. The sealing of the aquarium 40 may result in the presence of an air bubble 110 near the top of the aquarium 40, which the aquatic life 75 can access if desired. After the aquarium 40 has been attached to the timepiece 30 as shown in FIG. 11, the user may view the time display 35 while contemporaneously watching the aquatic life 75 frolic around the aquarium 40. Thus, when asked the time of day, an owner of the aquarium watch of the present invention can either give the correct time indicated on the display 35, or exclaim with great wit, "half past a Sea Monkey®!"

Due to the limited space provided by the aquarium of the present invention, it may be necessary to return the aquatic life to their original environment for nourishment and oxygen after a certain period of time. The aquarium of the present invention is adapted to retain Sea Monkeys® or hybrid brine shrimp for a period of twelve hours before it becomes necessary to return them to their separate environment. Of course, this time period may vary depending on the size and quantity of aquatic pets held within the aquarium. For example, if it was desired to introduce a tadpole or the like into the aquarium, it may be necessary to return to the tadpole to a larger living environment after only a couple of hours, depending of course on the sizes of the tadpole and the aquarium.

Figure 13:
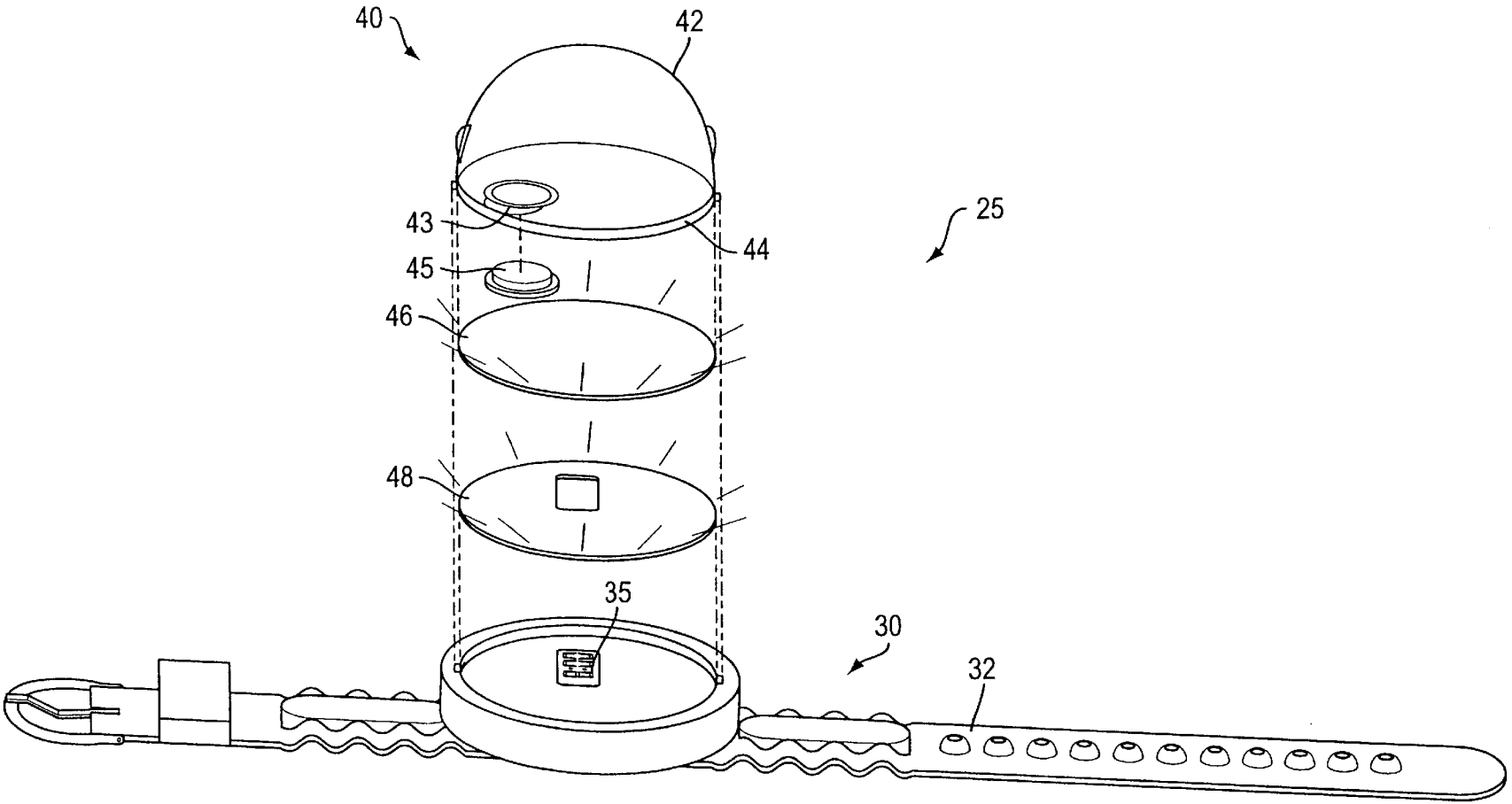
FIG. 13 is an exploded view of an aquarium watch of the present invention with optional phosphorescent elements attachable thereto.

FIG. 13 illustrates two possible methods for increasing the ability to view the contents of the aquarium 40. For example, a phosphorescent piece 46 may be snapped into the bottom surface 44 of the aquarium 40 to impart a glow to the aquarium 40 and its contents. Such piece 46 may be adapted to glow for a considerable period of time depending on its material composition and the extent to which such piece 46 is exposed to light. Such glow piece 46 is preferably configured and dimensioned for removable attachment to the aquarium 40, and more particularly the outer bottom surface 44 of the aquarium 40. Furthermore, depending on its material composition, the piece 46 may inhibit viewing of the time display 35 if and when the aquarium 40 is attached to the timepiece 30. Thus, the user of the invention may also be provided with the option of an interchangeable watch face 48, which is also preferably composed of phosphorescent material. Again, such phosphorescent material may be adapted to glow for a considerable period of time depending on its material composition, and preferably has a cutout for exposure of the time display 35 therethrough. The phosphorescent elements illustrated by way of example in FIG. 13 are particularly visually enhancing when used in conjunction with colored aquatic life as discussed in connection with FIG. 5B.

While FIG. 13 illustrates the addition of phosphorescent elements to the aquarium watch of the present invention, other viewing enhancements are contemplated. For example, the phosphorescent piece 46 may instead comprise a set of pieces having different colors or designs for creating unique visual environments. Thus, for example, the aquarium environment can be blue one day and red the next, or it could be a solid color one day and stripped or dotted the next. Alternative watch faces 48 may also be used, with ornamental possibilities being endless. Also, while FIG. 13 illustrates the use of phosphorescent material, which provides a residual glow upon an exposure to an ambient light source, other illuminating elements may be introduced or added to certain aspects of the invention to create even greater visual effects. Thus, for example, a LED element may be provided between the aquarium 40 and timepiece 30 that illuminates the contents of the aquarium 40 and/or timepiece 30 upon the activation of a switch or the push of a button. Similarly, other static and dynamically powered devices may be incorporated into the aquarium watch of the invention to increase the viewing environment and overall enjoyment to the user.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A wristwatch comprising:

a) a watch face, and b) an aquarium removably attached to said watch face, c) wherein said aquarium further comprises a plug member adapted to permit the introduction of aquatic life into said aquarium and further adapted to seal said aquatic life within said aquarium.

2. A wristwatch in accordance with claim 1, wherein said plug member is positioned adjacent said watch face when said aquarium is attached to said watch face.

3. A wristwatch in accordance with claim 1, wherein said aquarium is rotatingly removably attached to said watch face.

4. A wristwatch in accordance with claim 1, wherein said watch face further comprises a time display.

5. A wristwatch in accordance with claim 4, wherein said time display is digital.

6. A wristwatch in accordance with claim 4, wherein said time display is viewable through said aquarium when said aquarium is attached to said watch face.

7. A wristwatch in accordance with claim 4, wherein said time display is viewable through said aquarium when said aquarium is attached to said watch face and filled with aquatic life.

8. A wristwatch in accordance with claim 1, further comprising aquatic life adapted for insertion into said aquarium.

9. A wristwatch in accordance with claim 8, wherein said aquatic life is hybrid brine shrimp.

10. A wristwatch in accordance with claim 8, further comprising a transport member adapted to introduce said aquatic life into, and remove said aquatic life from, said aquarium.

11. A wristwatch in accordance with claim 1, further comprising a decorative element adapted for insertion between said aquarium and said watch face.

12. A wristwatch in accordance with claim 11, wherein said decorative element is a phosphorescent disc.

13. A wristwatch in accordance with claim 4, further comprising an interchangeable watch face.

14. An aquarium watch system comprising:

a) a wristwatch, b) an aquarium removably attachable to said wristwatch, c) a transport member for introducing aquatic life into said aquarium.

15. An aquarium watch system in accordance with claim 14, wherein said aquarium further comprises a plug member adapted to permit the introduction of aqueous fluid into said aquarium and further adapted to seal said aqueous fluid within said aquarium.

16. An aquarium watch system in accordance with claim 15, further comprising aquatic life adapted to survive in said aquarium.

17. An aquarium watch system in accordance with claim 16, wherein said aquatic life is adapted to survive for at least 12 hours in said aquarium.

18. An aquarium watch system in accordance with claim 16, wherein said aquatic life is hybrid brine shrimp.

19. An aquarium watch system in accordance with claim 16, further comprising means for coloring said aquatic life.

20. An aquarium watch kit comprising:

a) a watch for telling time, b) an aquarium removably attachable to said watch, said aquarium adapted to support aquatic life, c) aquatic life adapted to survive in said aquarium, d) a water purifier for preparing a separate living environment for said aquatic life, e) growth food for nourishing said aquatic life, and f) a transport member adapted to transport said aquatic life between said separate environment and said aquarium.

21. A method in accordance with claim 20, wherein said growth food further comprises coloring means for imparting color to said aquatic life.

22. A method in accordance with claim 21, wherein said coloring means further comprises dried algae.

23. A method of contemporaneously telling time and enjoying aquatic pets, comprising the steps of:

a) providing a timepiece having a time display, b) providing an aquarium constructed for removable attachment to said timepiece, said aquarium having a plug member adapted to permit the introduction aquatic pets into said aquarium and further adapted to seal said aquatic pets within said aquarium, and c) introducing aquatic pets into said aquarium.

24. A method in accordance with claim 23, further comprising the step of attaching said aquarium to said timepiece.

25. A method in accordance with claim 23, wherein said time display is viewable through said aquarium when said aquarium is attached to said timepiece.

26. A method in accordance with claim 23, wherein said aquarium is further rotatably attachable to said timepiece.

27. A method in accordance with claim 23, further comprising the step of introducing a phosphorescent element to said timepiece or said aquarium for illuminating said timepiece or said aquarium.

28. A combination timepiece and aquarium comprising:

a) a timepiece having a time display, and b) an aquarium removably attached to said timepiece, c) wherein said aquarium further comprises a plug member adapted to permit the introduction of aquatic life into said aquarium and further adapted to seal said aquatic life within said aquarium.

29. A combination timepiece and aquarium in accordance with claim 28, wherein said aquarium is rotatingly removably attached to said timepiece.

30. A combination timepiece and aquarium in accordance with claim 28, wherein said timepiece is adapted to be worn on a human wrist.

31. A combination timepiece and aquarium in accordance with claim 28, wherein said timepiece is adapted to be carried in a user's pocket.

32. A combination timepiece and aquarium in accordance with claim 28, further comprising aquatic life adapted for insertion into said aquarium.

33. A combination timepiece and aquarium in accordance with claim 32, wherein said aquatic life is hybrid brine shrimp.

34. A combination timepiece and aquarium in accordance with claim 28, further comprising a transport member adapted to introduce said aquatic life into, and remove said aquatic life from, said aquarium.

35. A combination timepiece and aquarium in accordance with claim 28, further comprising a decorative element provided on said timepiece or said aquarium for modifying the appearance of said combination timepiece and aquarium.

36. A combination timepiece and aquarium in accordance with claim 35, wherein said decorative element is a phosphorescent disc removably attachable to said aquarium.

37. A combination timepiece and aquarium in accordance with claim 35, wherein said decorative element is an interchangeable timepiece face.

* * * * *